US012560377B2

(12) United States Patent
Wang et al.

(10) Patent No.: US 12,560,377 B2
(45) Date of Patent: Feb. 24, 2026

(54) REFRIGERATOR

(71) Applicants: QINGDAO HAIER REFRIGERATOR CO., LTD., Qingdao (CN); HAIER SMART HOME CO., LTD., Qingdao (CN)

(72) Inventors: Hongyu Wang, Qingdao (CN); Xiaoqiang Bai, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 91 days.

(21) Appl. No.: 18/682,836

(22) PCT Filed: Mar. 31, 2022

(86) PCT No.: PCT/CN2022/084499
§ 371 (c)(1),
(2) Date: Feb. 9, 2024

(87) PCT Pub. No.: WO2023/015911
PCT Pub. Date: Feb. 16, 2023

(65) Prior Publication Data

US 2025/0027711 A1 Jan. 23, 2025

(30) Foreign Application Priority Data

Aug. 10, 2021 (CN) ..... 202110913303.2

(51) Int. Cl.
*F25D 23/12* (2006.01)
*F25D 23/00* (2006.01)
(Continued)

(52) U.S. Cl.
CPC ..... *F25D 23/126* (2013.01); *F25D 23/00* (2013.01); *F25D 23/064* (2013.01);
(Continued)

(58) Field of Classification Search
CPC ..... F25D 23/00; F25D 23/10; F25D 23/126; F25D 23/064; F25D 25/005; F25D 31/006; F25D 2331/81; F25D 11/00
See application file for complete search history.

(56) References Cited

U.S. PATENT DOCUMENTS

2007/0278141 A1 12/2007 Patera et al.
2018/0099857 A1* 4/2018 Comsa ..... B67D 1/124
(Continued)

FOREIGN PATENT DOCUMENTS

CN 112033064 A 12/2020
CN 212205301 U 12/2020
(Continued)

OTHER PUBLICATIONS

Machine Translation CN112033064 (Year: 2020).*

*Primary Examiner* — Joseph F Trpisovsky
(74) *Attorney, Agent, or Firm* — Muncy, Geissler, Olds & Lowe, P.C.

(57) ABSTRACT

A refrigerator includes a box body, inner container of which defines a storage compartment therein; and a water storage device arranged in the storage compartment and comprising a pot body and a pot lid; the port body being configured to store water; the pot lid being arranged at the top of the pot body and configured to open and close the pot body; wherein the pot lid and the inner container detachably connected with each other. According to the refrigerator, the water storage device only takes up a small space inside the refrigerator and has no impact on a door body of the refrigerator. Meanwhile, the pot lid is detachably connected with the inner container, such that the water storage device not in need can be wholly removed from the refrigerator, which enlarges the internal space of the refrigerator.

11 Claims, 9 Drawing Sheets

(51) Int. Cl.

| | |
|---|---|
| *F25D 23/06* | (2006.01) |
| *F25D 25/00* | (2006.01) |
| *F25D 31/00* | (2006.01) |

(52) U.S. Cl.
CPC ..... *F25D 25/005* (2013.01); *F25D 31/006* (2013.01); *F25D 2331/81* (2013.01)

(56) References Cited

U.S. PATENT DOCUMENTS

| | | | | |
|---|---|---|---|---|
| 2019/0337790 | A1* | 11/2019 | Lee | B67D 3/0029 |
| 2023/0324108 | A1* | 10/2023 | Kim | F25D 23/12 |

FOREIGN PATENT DOCUMENTS

| | | | |
|---|---|---|---|
| CN | 113566492 | A | 10/2021 |
| CN | 113587544 | A | 11/2021 |
| KR | 1020120007198 | A | 1/2012 |
| RU | 2144166 | C1 | 1/2000 |
| RU | 2419047 | C2 | 5/2010 |

* cited by examiner

REFRIGERATOR

TECHNICAL FIELD

The present invention relates to the technical field of refrigerating and freezing devices, and in particular to a refrigerator.

BACKGROUND ART

In daily life, drinking cold water is a common water demand of people. For example, in hot summer, people often drink cold water to relieve the heat. As a common household appliance, a refrigerator is a common means to make cold water. At present, in a refrigerator having a water chilling module, there are generally two ways to realize the water chilling module. One way is to take a separate water box as a tool for making cold water when the refrigerator leaves the factory; the water box is usually independent in structure and is placed inside or in parallel with a drawer of the refrigerator; and when in use, the water box needs to be taken out manually and then put back into the refrigerator after being filled with water, and after water is cooled down, the water box is taken out for pouring water into a cup. The other way is to put the water chilling module in a door body, and the water chilling module is generally integrated with an ice maker of the door body. In the first solution, the water box in the refrigerator is independent and needs to be added with water manually, and after being added with water, the water box is heavy and inconvenient to take and place; and therefore, in the pursuit of intelligence today, such a solution fails to conform to the current concept of life and to provide people with more convenient life demands. In the second solution, since the water chilling module is placed in the door body of the refrigerator, the door body in this solution is thick and heavy and will take up more space inside the refrigerator, although water can be taken outside a box body without opening the door body of the refrigerator.

SUMMARY OF THE INVENTION

An objective of the present invention is to provide a removable water storage device.

A further objective of the present invention is to provide a refrigerator in which a water storage device is convenient to install and remove.

In particular, the present invention provides a refrigerator comprising:

a box body, an inner container of which defining a storage compartment therein; and a water storage device arranged in the storage compartment and comprising a pot body and a pot lid; the pot body being configured to storage water; the pot lid being arranged at the top of the pot body and configured to open and close the pot body; wherein the pot lid is detachably connected with the inner container.

Optionally, the inner container protrudes outward to form a socket; and the refrigerator further comprises a fixing box fitted in the socket and fixed to the socket; wherein the pot lid is provided with a body portion and a fixing portion located on a side of the body portion close to the inner container, and the fixing portion is detachably connected with the fixing box.

Optionally, a slot is formed in a top wall and/or a bottom wall of the fixing portion, and a jack is formed at a front wall and/or a rear wall of the fixing portion; and a flange is formed in the front part of a top wall and/or a bottom wall of the fixing box corresponding to the slot, and the flange is fitted in the slot through the jack to realize plug-in fixation of the fixing portion to the fixing box.

Optionally, the jack is formed at a rear wall of the fixing portion;

the slot is configured such that a left-and-right width of a side wall of the slot on a side close to the inner container gradually decreases from front to back; and the flange is configured such that a left-and-right width of the flange gradually increases from front to back.

Optionally, a clamping groove is also formed in the slot; and a protrusion is formed on the flange corresponding to the clamping groove, and the protrusion fits in the clamping groove.

Optionally, a shielding cover configured to fit the fixing box for shielding the fixing box after the pot lid is removed from the inner container.

Optionally, the water storage device further comprises a water intake pipe arranged in the pot lid and having an outlet end extending into the pot body, and an inlet end connected to an external water pipe to introduce water into the pot body;

a communicating opening is formed in the fixing portion; and a through hole is formed in a side wall of the socket, a pipe inserting opening is formed in a side wall of the fixing box corresponding to the through hole, and the external water pipe passes through the through hole and the pipe inserting opening to be connected to the water intake pipe.

Optionally, an anti-overflow plug with a pipe fixing hole formed therein, wherein the anti-overflow plug passes through the through hole on an outer side of the inner container, and the external water pipe passes through the pipe fixing hole to be fixed to the anti-overflow plug.

Optionally, at least one first fixing hole is formed in the side wall of the socket, and an adsorption head is formed on an outer side of the side wall corresponding to the first fixing hole;

a second fixing hole is formed in a side wall of the fixing box corresponding to the first fixing hole; and the refrigerator further comprises a screw davit which fits and is fixed to the adsorption head, and a fixing member passes through the second fixing hole, the first fixing hole and the adsorption head to fix the fixing box to the inner container.

Optionally, the inlet end of the water intake pipe is detachably connected with the external water pipe by means of a quick connector; and the quick connector comprises a first connecting pipe joint and a second connecting pipe joint, the inlet end of the water intake pipe is inserted into the first connecting pipe joint, the second connecting pipe joint is provided with a first pipe section and a second pipe section connected to each other, a tail end of the first pipe section is inserted into the second connecting pipe joint, an outlet end of the external water pipe is inserted into the second pipe section, and an inner diameter of the second pipe section is greater than that of the first pipe section.

Optionally, the water intake pipe is a flexible pipe, of which at least some sections are of spirally-bent structures.

Optionally, a plug-in post is formed on a bottom cover of the pot lid, and the outlet end of the water intake pipe is inserted into the plug-in post; and a support plate is further formed on the bottom cover close to the plug-in post, a first notch and a second notch are sequentially formed in the support plate up and down, a size of the second notch is larger than that of the first notch, and some pipe sections of the water intake pipe are fitted into in the second notch through the first notch.

According to the refrigerator provided by the present invention, the water storage device is arranged inside a storage compartment, so that the water storage device only takes up a small space inside the refrigerator and has no impact on a door body of the refrigerator. Meanwhile, a pot lid is detachably connected with an inner container, such that the water storage device not in need can be wholly removed from the refrigerator, which enlarges the internal space of the refrigerator.

The aforesaid and other objectives, advantages and features of the present invention will be more apparent to those skilled in the art from the following detailed description of the specific embodiments of the present invention with reference to the accompanying drawings.

BRIEF DESCRIPTION OF THE DRAWINGS

The followings will describe some specific embodiments of the present invention in detail in an exemplary rather than restrictive manner with reference to the accompanying drawings. The same reference signs in the drawings represent the same or similar components or parts. Those skilled in the art shall understand that these drawings may not be necessarily drawn according to the scales. In the drawings.

DETAILED DESCRIPTION

Figure 1:
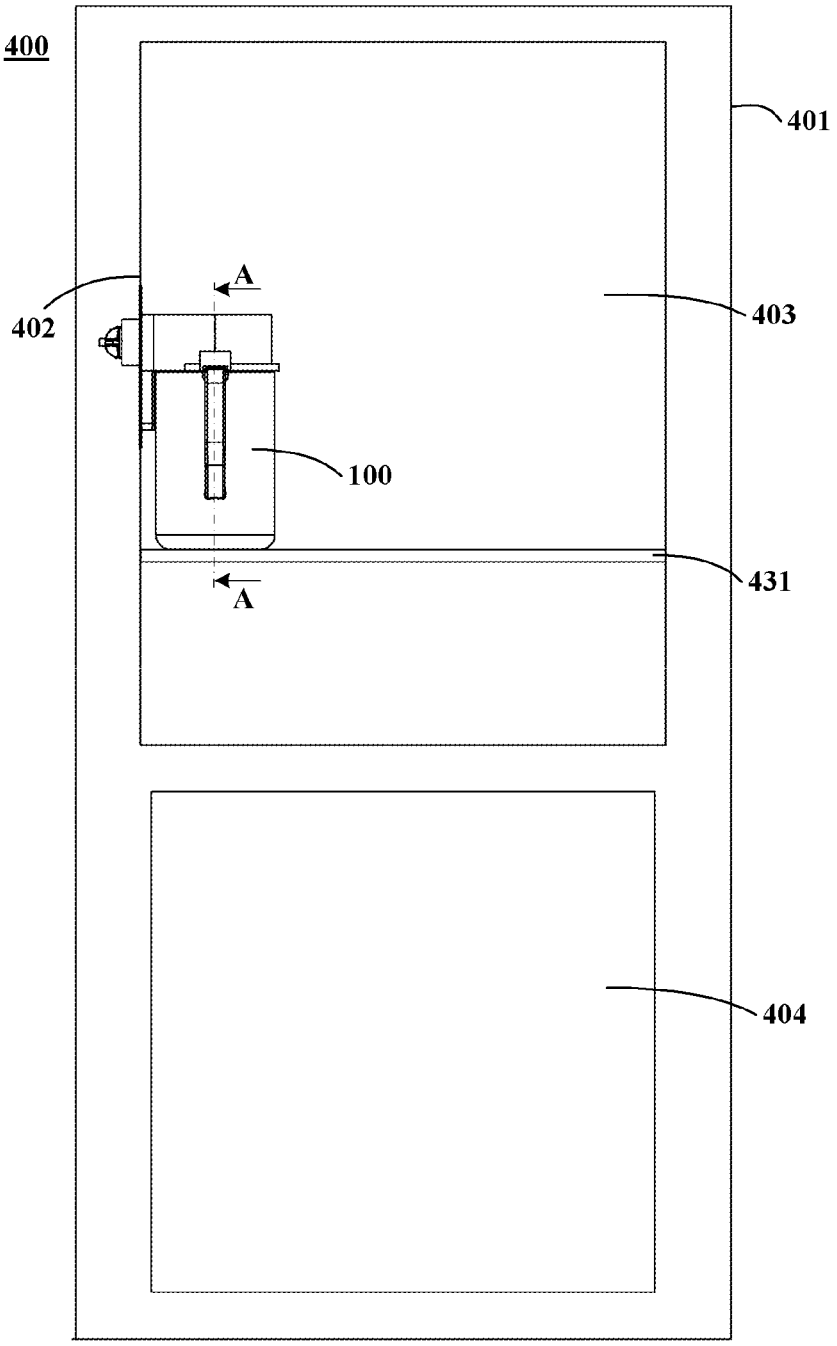
FIG. 1 is a schematic structural diagram of a refrigerator having a water storage device according to an embodiment of the present invention.
Figure 2:
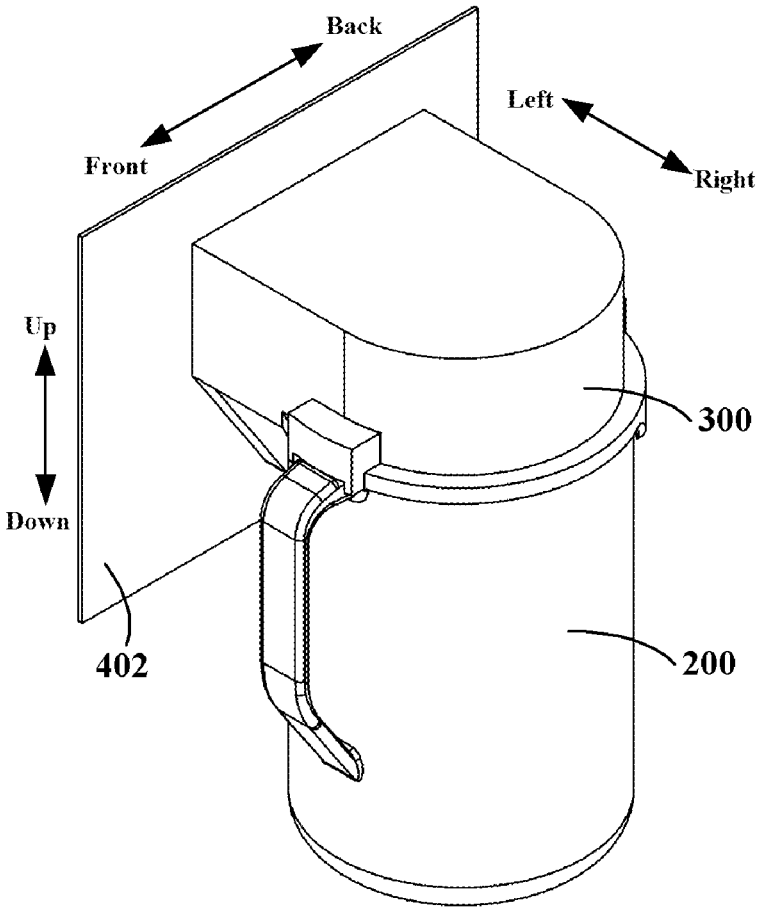
FIG. 2 is a schematic structural diagram of the water storage device, an inner container and the like shown in FIG. 1.
Figure 3:
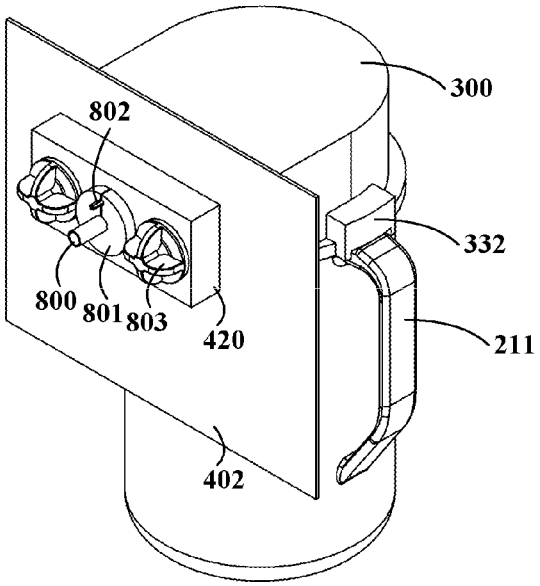
FIG. 3 is another schematic structural diagram of the water storage device, the inner container and the like shown in FIG. 2.
Figure 4:
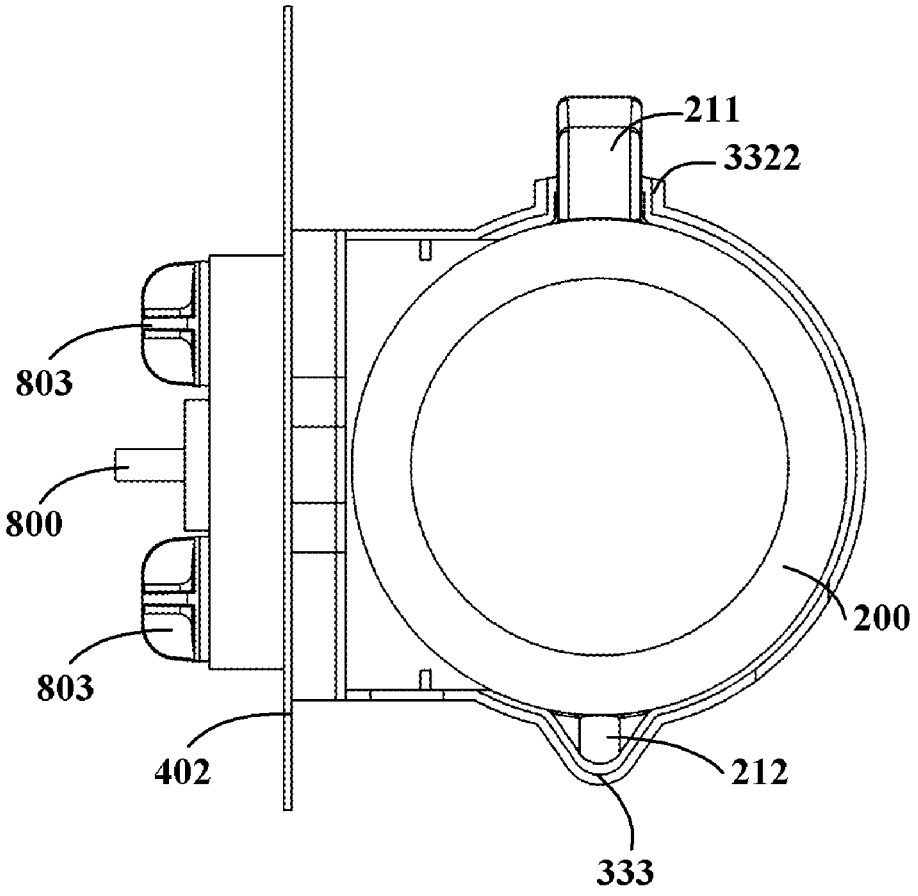
FIG. 4 is a schematic top view of the water storage device, the inner container and the like shown in FIG. 2.
Figure 5:
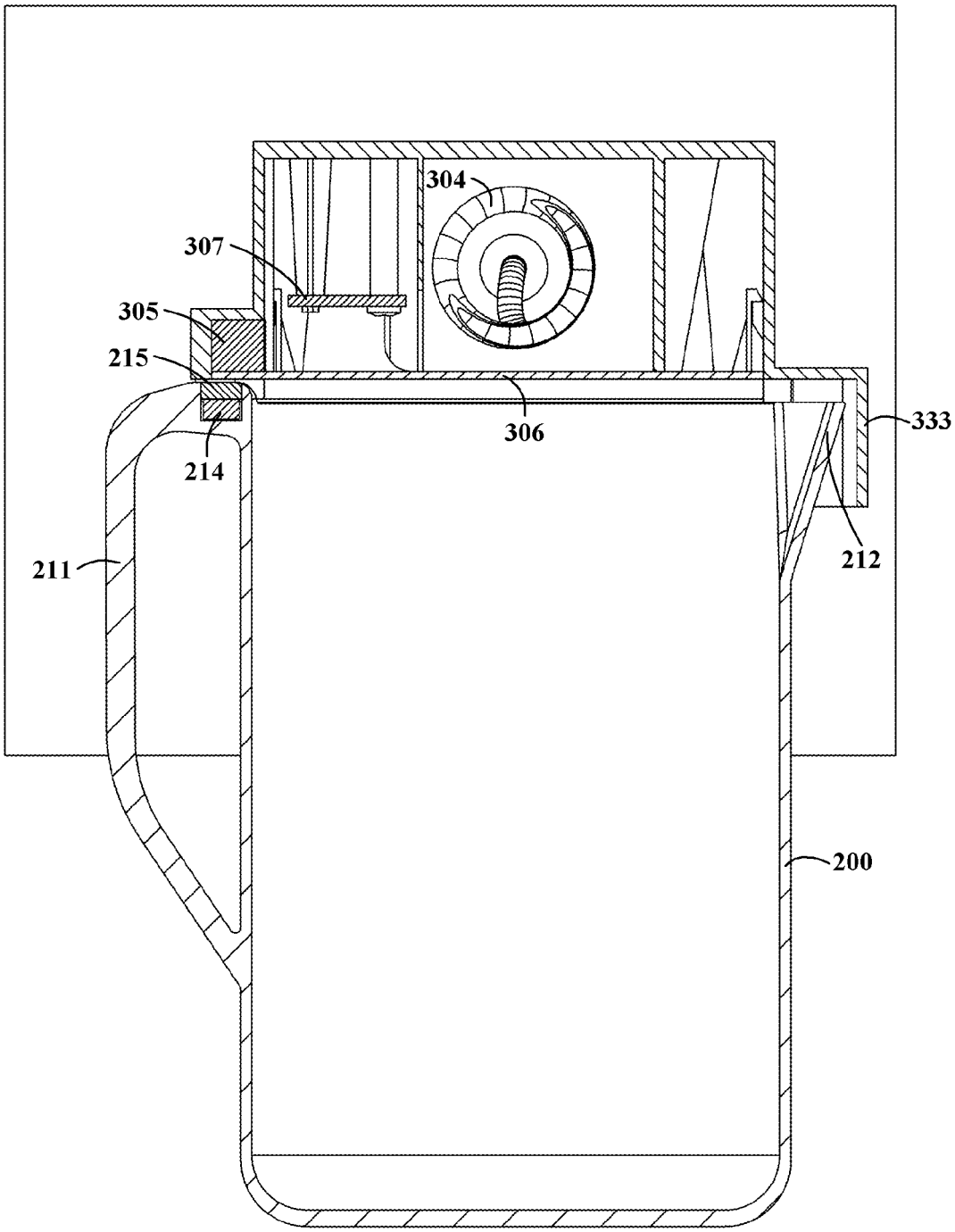
FIG. 5 is a schematic sectional view of the water storage device, the inner container and the like shown in FIG. 2 along line A-A in FIG. 1.

FIG. 1 is a schematic structural diagram of a refrigerator 400 having a water storage device 100 according to an embodiment of the present invention. FIG. 2 is a schematic structural diagram of the water storage device 100, the inner container 402 and the like shown in FIG. 1. FIG. 3 is another schematic structural diagram of the water storage device 100, the inner container 402 and the like shown in FIG. 2. FIG. 4 is a schematic top view of the water storage device 100, the inner container 402 and the like shown in FIG. 2. FIG. 5 is a schematic sectional view of the water storage device 100, the inner container 402 and the like shown in FIG. 2 along line A-A in FIG. 1.

An embodiment of the present invention provides a refrigerator 400, which is a storage device including a refrigerating system, and generally includes a box body 401, a door body (not shown in the figure), the refrigerating system (not shown in the figure) and a water storage device 100. The box body 401 includes a housing, an inner container 402, a heat insulating layer located between the housing and the inner container 402, etc. At least one storage compartment with an open front side is defined in the inner container 402 of the box body 401. There are usually a plurality of storage compartments, such as a refrigerating compartment 403, a freezing compartment 404 and a variable-temperature compartment. The specific number and functions of the storage compartments can be configured according to prior demands; for example, the preservation temperature of the refrigerating compartment 403 may be 2° C. to 9° C. or 4° C. to 7° C.; and the preservation temperature of the freezing compartment 404 may be −22° C. to −14° C. or −20° C. to −16° C. As shown in FIG. 1, the storage compartment includes the refrigerating compartment 403 and the freezing compartment 404, and the freezing compartment 404 is arranged under the refrigerating compartment 403. The refrigerating system may be a compression refrigeration cycle system consisting of a compressor, a condenser, a throttling device, an evaporator and the like.

As shown in FIG. 1, according to an embodiment of the present invention, the water storage device 100 is arranged in the storage compartment of the refrigerator 400, and includes a pot body 200 and a pot lid 300. The pot body 200 is configured for water storage. The pot lid 300 is arranged at the top of the pot body 200 and configured to open and close the pot body 200. The pot lid 300 is detachably connected with the inner container 402. In FIG. 1, the water storage device 100 is arranged on a partition 431 in the refrigerating compartment 403. In the refrigerator 400 according to the embodiment of the present invention, the water storage device 100 is arranged in the storage compartment, so that the water storage device 100 only takes up a small space inside the refrigerator 400 and has no impact on a door body of the refrigerator 400. Meanwhile, the pot lid 300 is detachably connected with the inner container 402, so that the water storage device 100 not in need can be removed from the refrigerator 400, which enlarges the internal space of the refrigerator 400.

Figure 6:
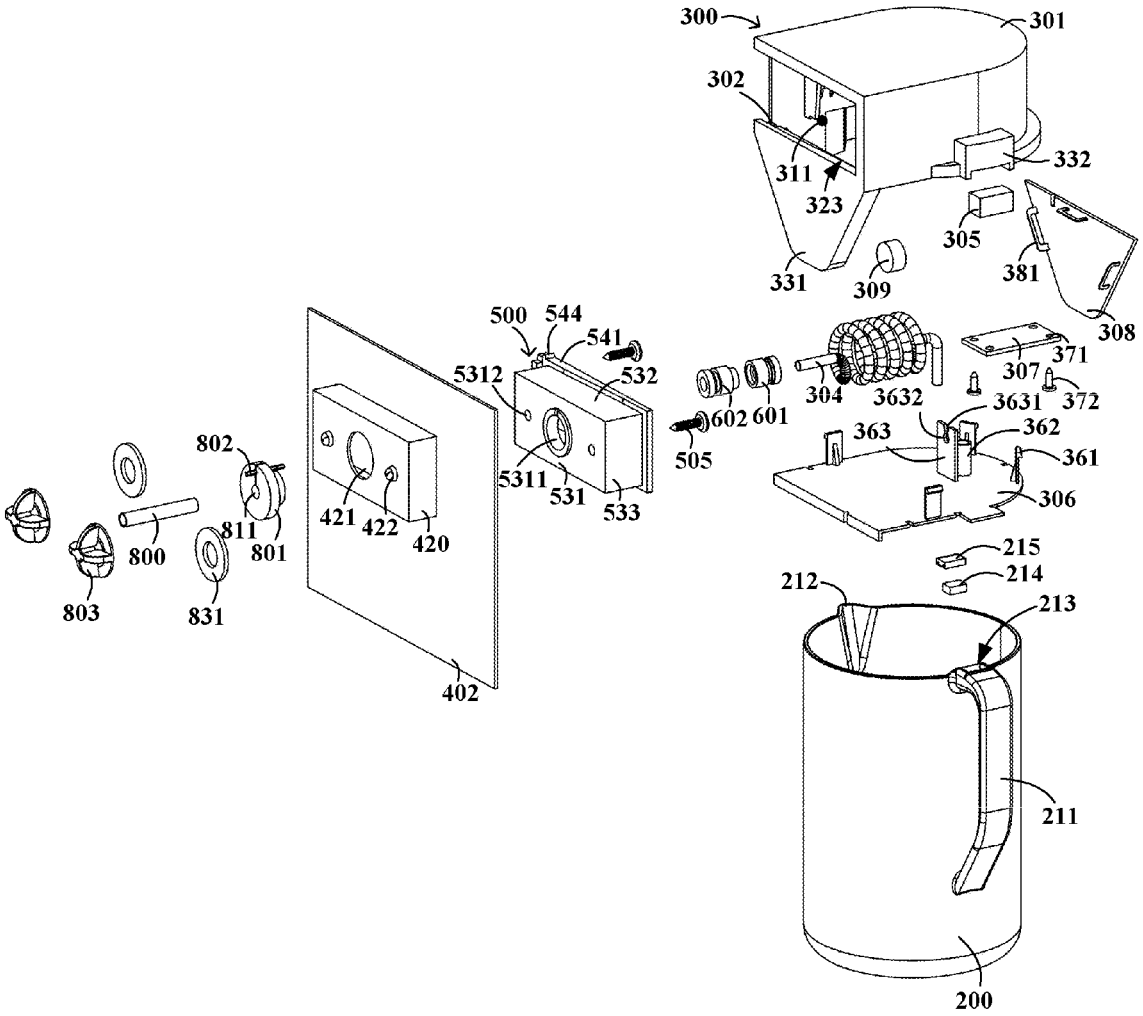
FIG. 6 is a schematic exploded diagram of the water storage device, the inner container and the like shown in FIG. 2.
Figure 7:
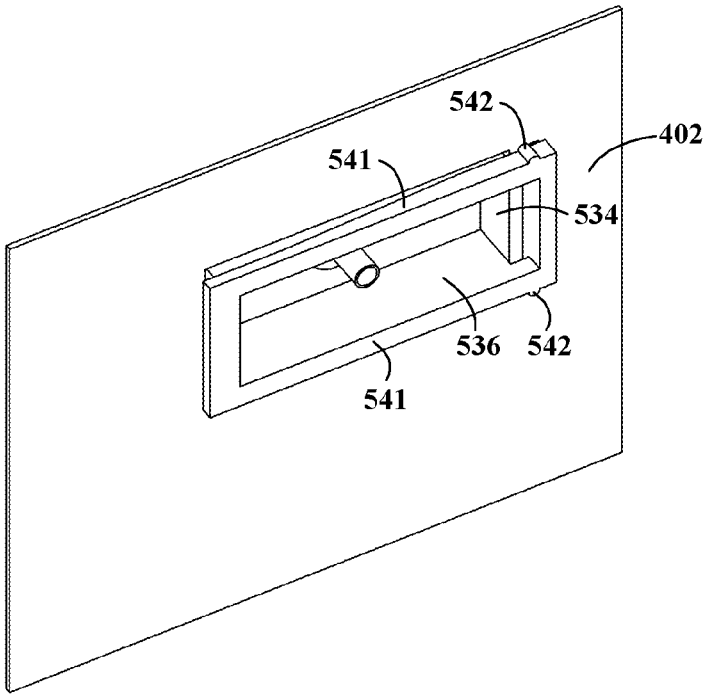
FIG. 7 is a schematic structural diagram of the inner container shown in FIG. 2 and a fixing box.
Figure 8:
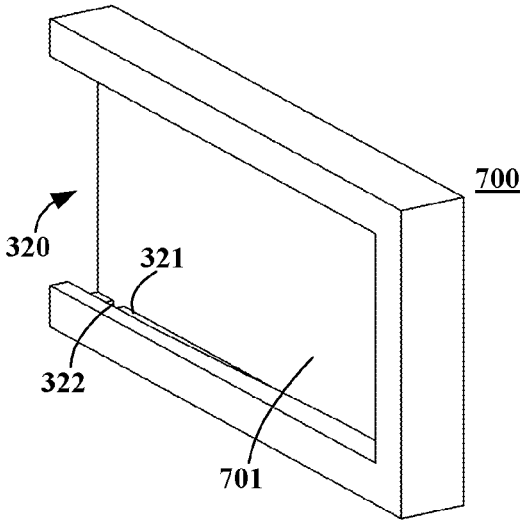
FIG. 8 is a schematic structural diagram of a shielding cover.

FIG. 7 is a schematic structural diagram of the inner container 402 shown in FIG. 2 and a fixing box 500. FIG. 8 is a schematic structural diagram of a shielding cover 700. FIG. 10 is a partial sectional view of a water intake pipe 304, a quick connector 600 and an external water pipe 800 of the water storage device 100 shown in FIG. 2. The water intake structure of the water storage device 100 and a mating structure within the refrigerator 400 according the embodiment of the present invention will be described in detail below with reference to FIGS. 6 to 10.

In some embodiments, according to an embodiment of the present invention, the inner container 402 of the refrigerator 400 protrudes outward to form a socket 420. The refrigerator 400 further includes a fixing box 500 fitted in the socket 420 and fixed to the socket 420; and the pot lid 300 is provided with a body portion 301 and a fixing portion 302 located on the side of the body portion 301 close to the inner container 402, and the fixing portion 302 is detachably connected with the fixing box 500. By providing the fixing box 500, the fixing box 500 may be fixed to the inner container 402 first, and then the pot lid 300 may be fixed to the fixing box 500 to realize fixing of the pot lid 300 to the inner container 402. In one aspect, the water storage device 100 may be of a detachable structure, so that a user can remove the water storage device 100 when there is no need for cold water, so as to acquire more available space inside the refrigerator 400, and in another aspect, compared with formation of the mating structure by directly molding the inner container 402, the fixing box 500 may be of a more complicated and refined structure, thus ensuring the installation stability of the pot lid 300, the fixing box 500 and the inner container 402 and the leakproofness of the butt joint.

According to an embodiment of the present invention, a slot 321 is formed in a top wall and/or a bottom wall of the fixing portion 302 of the pot lid 300 of the water storage device 100, and a jack 320 is formed at a front wall and/or a rear wall of the fixing portion 302. A flange 541 is formed in the front part of a top wall 532 and/or a bottom wall 536 of the fixing box 500 corresponding to the slot 321, and the flange 541 is fitted in the slot 321 through the jack 320 to realize plug-in fixation of the fixing portion 302 to the fixing box 500. By forming the slot 321 and the jack 320 in the fixing portion 302 and the flange 541 on the fixing box 500, the fixing portion 302 can be simply and conveniently fixed to the fixing box 500. The slot 321 may have a first side wall on a side close to the inner container 402 and a second side wall on a side away from the inner container 402 in all sections, i.e., have a left side wall and a right side wall, or only have a side wall on the side close to the inner container 402 in some sections. As shown in FIG. 6, the slots 321 are formed in the top wall and the bottom wall of the fixing portion 302 of the pot lid 300 respectively, and the jack 320 is formed at the rear wall of the fixing portion 302. The slot 321 located on the top wall of the fixing portion 302, other than the jack 320, only has a side wall on the side close to the inner container 402, while the slot 321 located on the bottom wall of the fixing portion 302 has a left side wall and a right side wall. As shown in FIGS. 6 and 7, the fixing box 500 has a side wall 531, a top wall 532, a front wall 533, a rear wall 534 and a bottom wall 536. The front wall 533 and the rear wall 534 are opposite to each other front and back, and the top wall 532 and the bottom wall 536 are opposite to each other up and down. The flanges 541 are formed in the front part of the top wall 532 and the bottom wall 536 respectively.

In some embodiments, the jack 320 is formed at the rear wall of the fixing portion 302; the slot 321 is configured such that the left-and-right width of the side wall of the slot 321 on the side close to the inner container 402 gradually decreases from front to back; and the flange 541 is configured such that the left-and-right width of the flange 541 gradually increases from front to back. As shown in FIG. 7, after the fixing box 500 and the inner container 402 are fitted and fixed together, there is a space between the flange 541 and the inner container 402, the flange 541 is provided such that the left-and-right width of the flange 541 gradually increases from front to back, i.e., the distance between the flange 541 and the inner container 402 gradually decreases from front to back, while the slot 321 is configured such that the left-and-right width of the side wall on the side close to the inner container 402 gradually decreases from front to back. That is, the left-and-right width of the slot 321 gradually increases. The side wall of the slot 321 on the side close to the inner container 402 and the flange 541 are designed in a shape follow-up manner, so that when the pot lid 300 is installed, the fixing portion 302 and the fixing box 500 are fixed more tightly as the pot lid 300 is pushed backward along the flange 541.

In some embodiments, a clamping groove 322 is also formed in the slot 321; and a protrusion 542 is formed on the flange 541 corresponding to the clamping groove 322, and the protrusion 542 fits in the clamping groove 322. Generally, the clamping groove 322 is formed only in the slot 321 located on the bottom wall of the fixing portion 302, and the protrusions 542 are formed on the flanges 541 on the top wall 532 and the bottom wall 536 respectively. By forming the clamping groove 322 in the slot 321 and the protrusion 542 on the flange 541, it is more convenient to install and disassemble the pot lid 300. When the water storage device 100 is not in use, the user directly pulls the pot lid 300 forward to disengage the pot lid 300 from the fixing box 500.

According to an embodiment of the present invention, the refrigerator 400 further includes a shielding cover 700 configured to fit the fixing box 500 for shielding the fixing box 500 after the pot lid 300 is removed from the inner container 402. After the pot lid 300 is removed from the inner container 402, the fixing box 500 and the external water pipe 800 may be exposed in the field of vision. By providing the shielding cover 700, the external water pipe 800 can be prevented from being contaminated, and the refrigerator 400 is more beautiful. FIG. 8 is a schematic structural diagram of the shielding cover 700. The structure of the shielding cover 700 is similar to that of the fixing portion 302, and their main difference lies in that a communicating opening 323 for connection with the external water pipe 800 is not formed in a side wall 701 of the shielding cover 700. As shown in FIG. 8, the slots 321 are formed in a top wall and a bottom wall of the shielding cover 700, and the jack 320 is formed at the rear wall.

Figure 9:
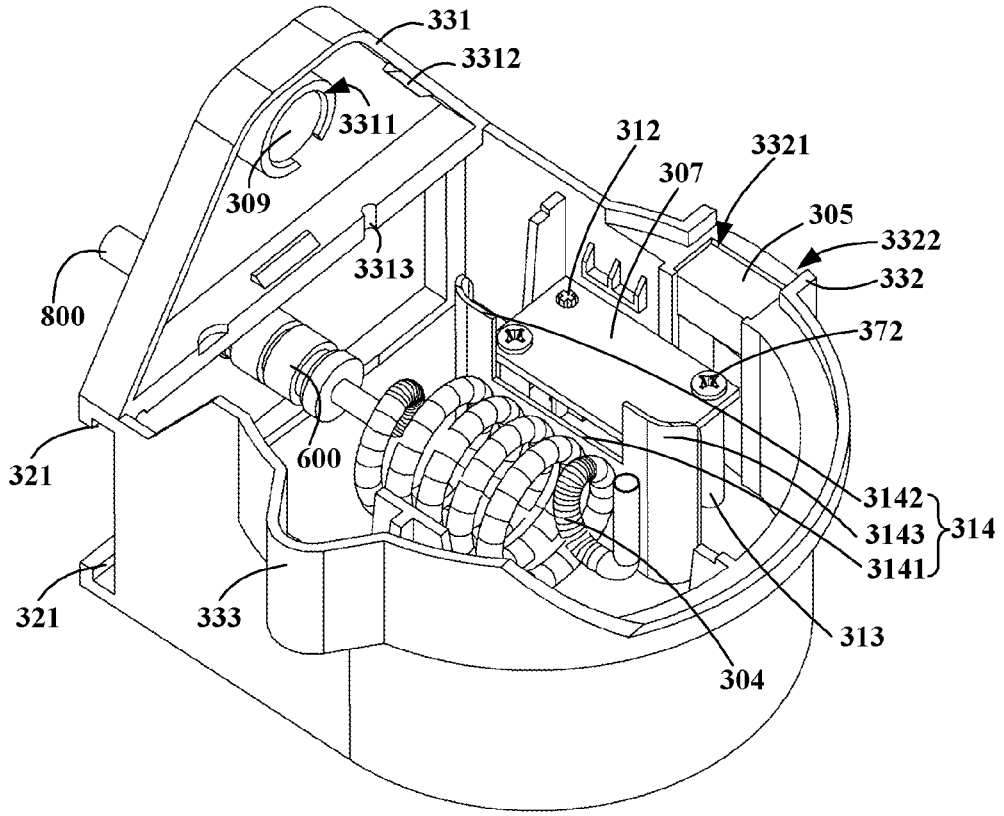
FIG. 9 is a schematic structural diagram of some components of a water intake pipe and a cover body of the water storage device shown in FIG. 2.
Figure 10:
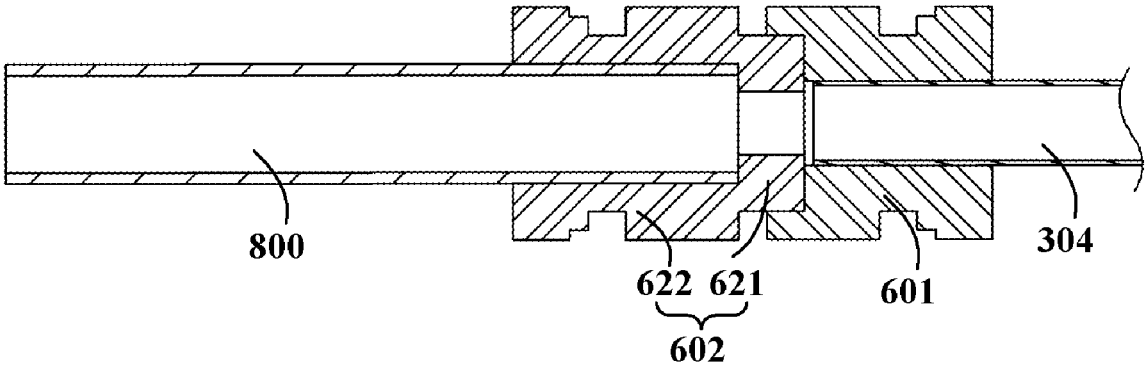
FIG. 10 is a partial sectional view of the water intake pipe, a quick connector and an external water pipe of the water storage device shown in FIG. 2.

As shown in FIG. 9, according to an embodiment of the present invention, the water storage device 100 further includes a water intake pipe 304, which is arranged in the pot lid 300 and has an outlet end extending into the pot body 200 and an inlet end connected to the external water pipe 800 to introduce water into the pot body 200. By providing the water intake pipe 304 in the pot lid 300, the water storage device 100 itself is provided with the water intake pipe 304, so that water can be conveniently introduced into the pot body 200. As shown in FIG. 6, an accommodating cavity 311 is defined in the body portion 301 of the pot lid 300, and the water intake pipe 304 is arranged in the accommodating cavity 311. According to an embodiment of the present invention, the communicating opening 323 is formed in the fixing portion 302 of the pot lid 300 of the water storage device 100. A through hole 421 is formed in a side wall of the socket 420 of the inner container 402. A pipe inserting opening 5311 is formed in the side wall 531 of the fixing box 500 corresponding to the through hole 421 The external water pipe 800 passes through the through hole 421 and the pipe inserting opening 5311 to be connected to the water intake pipe 304.

According to an embodiment of the present invention, the refrigerator 400 further includes an anti-overflow plug 801 with a pipe fixing hole 811 formed therein, the anti-overflow plug 801 passes through the through hole 421 on the outer side of the inner container 402, and the external water pipe 800 passes through the pipe fixing hole 811 to be fixed to the anti-overflow plug 801. A slot (not marked in the figure) for installing a wire harness 802 may also be formed in the anti-overflow plug 801.

According to an embodiment of the present invention, at least one first fixing hole (not shown in the figure) is formed in the side wall of the socket 420 of the inner container 402 of the refrigerator 400, and an adsorption head 422 is formed on the outer side of the side wall corresponding to the first fixing hole. A second fixing hole 5312 is formed in the side wall 531 of the fixing box 500 corresponding to the first fixing hole The refrigerator 400 further includes a screw davit 803, which fits and is fixed to the adsorption head 422. A fixing member 505 passes through the second fixing hole 5312, the first fixing hole and the adsorption head 422 to realize fixing of the fixing box 500 to the inner container 402.

By forming the first fixing hole in the side wall of the socket 420 and the second fixing hole 5312 in the side wall 531 of the fixing box 500, the fixing box 500 and the inner container 402 can be firmly fixed to each other. By forming the adsorption head 422 and the screw davit 803, the fixing box 500 can be installed after foaming. As shown in FIG. 6, the socket 420 is adsorbed onto the inner container 402, the adsorption heads 422 for installing the screw davit 803 during pre-assembly are designed on the outer side of the socket 420 corresponding to the first fixing hole and the second fixing hole 5312, and after foaming, the fixing box 500 is fixed, by means of the fixing member 505, for example, a screw, to the interior of the socket 420 adsorbed by the inner container 402. The external water pipe 800 and the wire harness first pass through the anti-overflow plug 801, and then the anti-overflow plug 801 is inserted into the through hole 421 of the inner container 402 and the pipe inserting opening 5311 of the fixing box 500. The anti-overflow plug 801 may be a rubber plug. In addition, a sealing ring 831 may be provided between the screw davit 803 and the outer side of the socket 420.

In some embodiments, according to an embodiment of the present invention, the inlet end of the water intake pipe 304 of the water storage device 100 is detachably connected with the external water pipe 800 by means of the quick connector 600. The quick connector 600 includes a first connecting pipe joint 601 and a second connecting pipe joint 602, wherein the inlet end of the water intake pipe 304 is inserted into the first connecting pipe joint 601; the second connecting pipe joint 602 is provided with a first pipe section 621 and a second pipe section 622 connected to each other; the tail end of the first pipe section 621 is inserted into the second connecting pipe joint 602; the outlet end of the external water pipe 800 is inserted into the second pipe section 622; and the internal diameter of the second pipe section 622 is greater than that of the first pipe section 621. By detachably connecting the water intake pipe 304 to the external water pipe 800 using the quick connector 600, the water storage device 100 can be separated from the external water pipe 800 when access to water is not required, so that the water storage device 100 can be stored and used independently. The water intake pipe 304 and the external water pipe 800 are connected using the quick connector 600, which is provided with the first connecting pipe joint 601 and the second connecting pipe joint 602, so that they can be connected and disconnected for many times. In case of access to water, the water intake pipe 304 may be directly inserted into the first connecting pipe joint 601, the external water pipe 800 may be directly inserted into the second connecting pipe joint 602, and then the first pipe section 621 of the second connecting pipe joint 602 may be inserted into the first connecting pipe joint 601. In case of no access to water, the quick connector 600 is forcibly pulled, so that the first connecting pipe joint 601 and the second connecting pipe joint 602 of the quick connector 600 are separated, realizing disengagement of the water intake pipe 304 from the external water pipe 800 in the box body 401.

According to an embodiment of the present invention, the water intake pipe 304 of the water storage device 100 is preferably a flexible pipe, and at least some sections thereof are of spirally-bent structures. The water intake pipe 304 is provided as a flexible pipe and is of a spirally-bent structure, so that it is convenient to pull the water intake pipe 304, thereby facilitating abutment between the first connecting pipe joint 601 and the second connecting pipe joint 602.

As shown in FIG. 6, according to an embodiment of the present invention, a plug-in post 362 is formed on a bottom cover plate 306 of the pot lid 300 of the water storage device 100, and the outlet end of the water intake pipe 304 is inserted into the plug-in post 362. Meanwhile, a support plate 363 is also formed on the bottom cover plate 306 close to the plug-in post 362. A first notch 3631 and a second notch 3632 are sequentially formed in the support plate 363 up and down. The size of the second notch 3632 is larger than that of the first notch 3631. Some pipe sections of the water intake pipe 304 are fitted into the second notch 3632 through the first notch 3631. By forming the support plate 363 having both of the first notch 3631 and the second notch 3632 close to the plug-in post 362, the water intake pipe 304 and the bottom cover plate 306 can be stably connected in case of access or no access to water, so that the outlet end of the water intake pipe 304 is prevented from being disengaged from the plug-in post 362 when the water intake pipe 304 is pulled.

In some embodiments, according to an embodiment of the present invention, a magnetic member 214 is arranged on the pot body 200 of the water storage device 100. The pot lid 300 is provided with a magnetic sensitive switch 305, so that the positional states of the pot body 200 and the pot lid 300 can be determined by using a sensing signal of the magnetic sensitive switch 305 to the magnetic member 214. In the water storage device 100 and the refrigerator 400 according to the embodiment of the present invention, the water storage device 100 includes the pot body 200 and the pot lid 300, the pot body 200 is provided with the magnetic member 214, and the pot lid 300 is provided with the magnetic sensitive switch 305, so that the positional states of the pot body 200 and the pot lid 300 can be determined by using the sensing signal of the magnetic sensitive switch 305 to the magnetic member 214. When the magnetic sensitive switch 305 is turned on after sensing the magnetic member 214, it indicates that the pot body 200 is put in place, otherwise, it indicates that the pot body 200 is not put in place, thereby ensuring that the pot lid 300 and the pot body 200 fit in place.

According to an embodiment of the present invention, the pot body 200 of the water storage device 100 is provided with a handle 211, a magnet placing groove 213 is formed in the handle 211, and the magnetic member 214 is arranged in the magnet placing groove 213. A switch placing groove 3321 is formed in the pot lid 300 corresponding to the magnet placing groove 213, and the magnetic sensitive switch 305 is placed in the switch placing groove 3321. By providing the magnetic member 214 in the magnet placing groove 213 located on the handle 211, the magnetic member 214 can be added only by adjusting the structure at the handle 211 without influencing the internal structure of the pot body 200. According to an embodiment of the present invention, the water storage device 100 determines whether the pot body 200 is put in or not according to on/off of the magnetic sensitive switch 305, so that the magnetic sensitive switch 305 must be within the effective magnetic range of the magnetic member 214 when the pot body 200 is put in correctly. The magnetic force of the magnetic member 214 is related to the type of the magnetic member 214. The magnetic member 214 may be a magnet. Magnets of different specifications have different effective magnetic radii r. Generally, taking the cost into consideration, the water storage device 100 according to the embodiment of the present invention uses a magnet with an effective magnetic radius of $r \leq 20$ mm as the magnetic member 214. Correspondingly, the distance between the magnetic sensitive switch 305 and the magnet should also be within 20 mm.

As shown in FIG. 5, in some embodiments, in the water storage device 100 according to an embodiment of the present invention, the magnet placing groove 213 has an upward opening. The pot body 200 further includes a fixing cover 215 for closing the magnet placing groove 213 after the magnet 214 is placed in the magnet placing groove 213. Since the magnet placing groove 213 has the upward opening, the overall appearance of the water storage device 100 can be kept smooth, and the manufacturing process is simpler; and by providing the fixing cover 215, the magnetic member 214 can be kept in the magnet placing groove 213 to interact with the magnetic sensitive switch 305. The fixing cover 215 may be fixed to the handle 211 by means of a hook and groove structure.

In some embodiments, according to an embodiment of the present invention, the pot lid 300 of the water storage device 100 further includes a switch extension 332 protruding outward from the body portion 301, the switch extension 332 extends above the magnet placing groove 213, and a switch placing groove 3321 is formed in the switch extension 332. The pot lid 300 further includes a bottom cover plate 306, which is arranged below the body portion 301 and the switch extension 332 for closing the body portion 301 and the switch extension 332. By extending the switch extension 332 above the handle 211, forming the switch placing groove 3321 in the switch extension 332, and closing the body portion 301 and the switch extension 332 using the bottom cover plate 306, the magnetic sensitive switch 305 can be simply and conveniently arranged in the pot lid 300. Meanwhile, by forming the switch extension 332, the pot lid 300 itself may be in a certain style, so that the visual effect of the whole water storage device 100 is improved. FIG. 6 is a schematic exploded diagram of the water storage device 100, the inner container 402 and the like shown in FIG. 2. FIG. 9 is a schematic structural diagram of some components of the water intake pipe 304 and a cover body of the water storage device 100 shown in FIG. 2. As shown in FIG. 6, the bottom cover plate 306 is provided with a plurality of hooks 361, and correspondingly, a plurality of protrusions (not marked in the figure) are formed on the inner side of the body portion 301. The hooks 361 and the protrusions of the body portion 301 work together to realize fixing of the bottom cover plate 306 to the body portion 301.

In some embodiments, according to an embodiment of the present invention, a handle 211 is arranged on the front side of the pot body 200 of the water storage device 100. A switch extension 332 is formed by extending and protruding outward from the front side of the body portion 301, and an abutting groove 3322 with a downward opening is further formed in the lower portion of the switch extension 332, so that the abutting groove 3322 stretches across the left and right sides of the handle 211 when the pot body 200 is fitted under the pot lid 300. By forming the abutting groove 3322 with a downward opening in the lower portion of the switch extension 332, the abutting groove 3322 may stretch cross the left and right sides of the handle 211 when the pot body 200 is fitted under the pot lid 300, so that a limiting structure may be added to the pot body 200 and the pot lid 300 at the handle 211, which is beneficial for the user to quickly and accurately position the pot body 200 in place under the pot lid 300.

In some embodiments, according to an embodiment of the present invention, the upper portion of the rear side of the pot body 200 of the water storage device 100 extends and protrudes outward to form a spout 212. The pot lid 300 further includes a mouth extension 333 extending and protruding downward and outward from the lower portion of the rear side of the body portion 301, so that the spout 212 fits in the mouth extension 333 when the pot body 200 is fitted under the pot lid 300. By forming the mouth extension 333 on the rear side of the pot body 200 corresponding to the spout 212, the spout 212 may be fitted in the mouth extension 333 when the pot body 200 is fitted under the pot lid 300, so that a limiting structure may be added to the pot body 200 and the pot lid 300 at the spout 212, which is also beneficial for the user to quickly and accurately position the pot body 200 in place under the pot lid 300.

As shown in FIGS. 3 to 5, in the water storage device 100 according to an embodiment of the present invention, a handle 211 is arranged on the front side of the pot body 200. A switch extension 332 is formed by extending and protruding outward from the front side of the body portion 301, and an abutting groove 3322 with a downward opening is also formed in the lower portion of the switch extension 332. A spout 212 is arranged on the rear side of the pot body 200. A mouth extension 333 is formed by extending and protruding outward and downward from the lower portion of the rear side of the body portion 301 to cover the upper portion of the spout 212. In a preferred embodiment, the outer contour of a projection of the mouth extension 333 onto a horizontal plane is in the same shape as the outer contour of a projection of the spout 212 onto the horizontal plane. Since the outer contour of the projection of the mouth extension 333 onto the horizontal plane is set in the same shape as the outer contour of the projection of the spout 212 onto the horizontal plane, the limiting is more accurate, the spout 212 and the pot lid 300 are clung to each other in a shape follow-up manner after the pot body 200 is placed under the pot body 200, and the overall appearance of the water storage device 100 is more beautiful.

Figure 11:
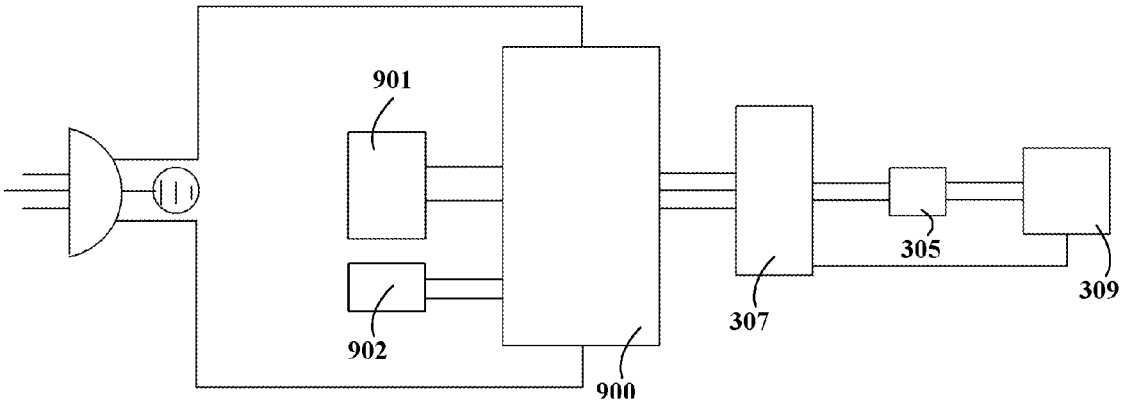
FIG. 11 is a schematic circuit diagram of the water storage device shown in FIG. 2.
Figure 12:
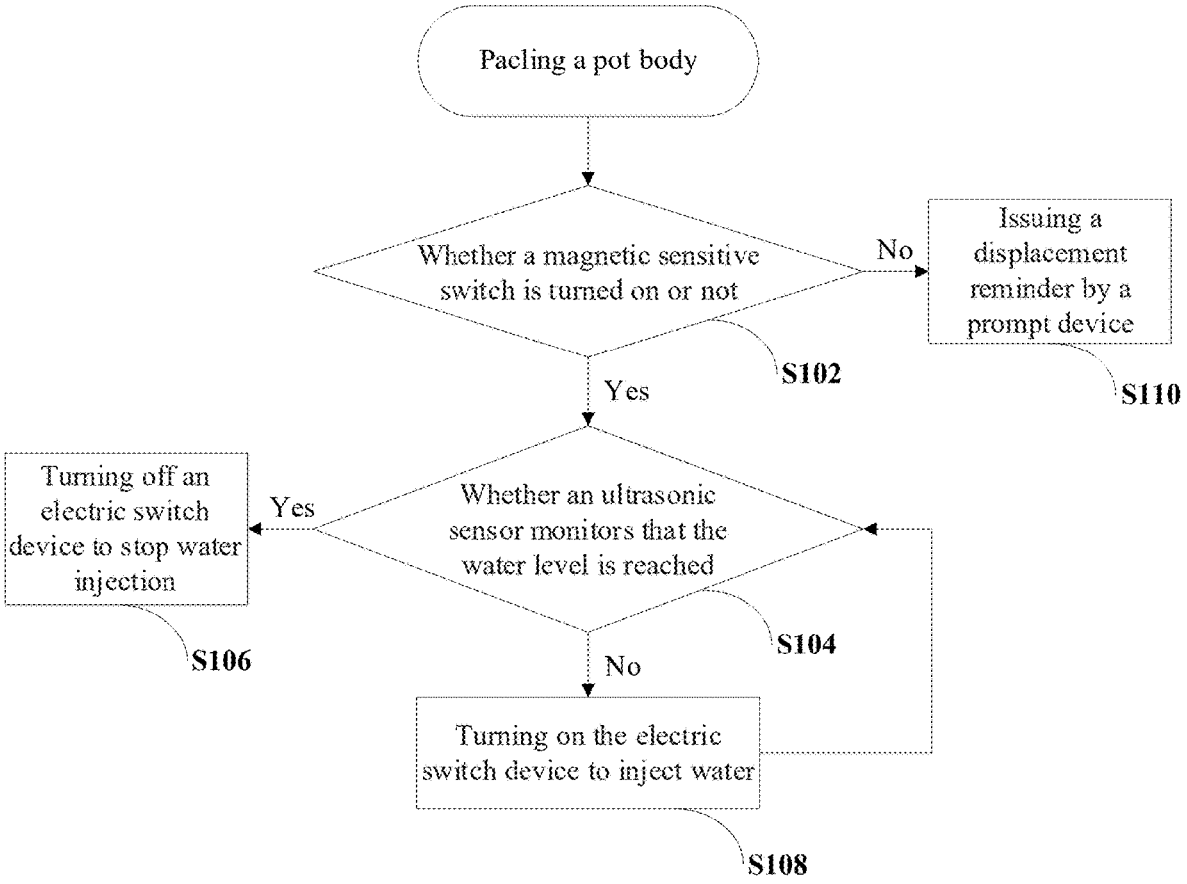
FIG. 12 is a control flow chart of placing a pot body of the water storage device shown in FIG. 2 into the inner container.

FIG. 11 is a schematic circuit diagram of the water storage device 100 shown in FIG. 2. FIG. 12 is a control flow chart of placing the pot body 200 of the water storage device 100 shown in FIG. 2 into the inner container 402. The water level monitoring and control of the water storage device 100 according to the embodiments of the present invention will be described in detail below with reference to FIG. 6, FIG. 9, FIG. 11 and FIG. 12.

According to an embodiment of the present invention, the pot lid 300 of the water storage device 100 further includes a sensor extension 331 extending downward from the body portion 301. According to an embodiment of the present invention, the water storage device 100 further includes an ultrasonic sensor 309, which is arranged in the sensor extension 331 and configured to monitor the water level in the pot body 200. By forming the sensor extension 331 on the pot lid 300 and providing the ultrasonic sensor 309 in the sensor extension 331, it is convenient to monitor the water level in the pot body 200.

As shown in FIG. 9, a sensor placing groove 3311 is formed in the sensor extension 331; and an ultrasonic sensor 309 is fixed in the sensor placing groove 3311. In addition, a line passing opening 3313 is also formed at the joint between the sensor extension 331 and the body portion 301.

As shown in FIG. 6, the sensor extension 331 has an opening facing one side of the pot body 200. According to an embodiment of the present invention, the pot lid 300 of the water storage device 100 further includes a side cover plate 308 detachably connected with the sensor extension 331 and configured to open and close the sensor extension 331. Specifically, a plurality of clamping protrusions 3312 are formed at intervals inside the sensor extension 331; and snap rings 381 are formed on the side cover plate 308 corresponding to the clamping protrusions 3312, and the snap rings 381 match the clamping protrusions 3312 to realize fixation of the side cover plate 308 to the sensor extension 331. By providing the side cover plate 308 having the plurality of snap rings 381, the side cover plate 308 may be detachably connected with the sensor extension 331, which facilitates arrangement of the ultrasonic sensor 309.

The distance between the ultrasonic sensor 309 and the inner wall of the pot body 200 (i.e., the distance between the ultrasonic sensor 309 and the water surface) is determined according to the performance of the ultrasonic sensor 309. Generally, the distance between the ultrasonic sensor 309 and the water surface is not more than 20 mm. As mentioned above, the handle 211 is arranged on the front side of the pot body 200. The switch extension 332 is formed by extending and protruding outward from the front side of the body portion 301, and an abutting groove 3322 with a downward opening is also formed in the lower portion of the switch extension 332. A spout 212 is arranged on the rear side of the pot body 200. The mouth extension 333 is formed by extending and protruding outward and downward from the lower portion of the rear side of the body portion 301 to cover the upper portion of the spout 212. Limiting structures at these two positions can ensure that the pot body 200 is quickly placed in place, and the relative positional relationship between the ultrasonic sensor 309 and the pot body 200 are always kept unchanged, thus ensuring the distance between the ultrasonic sensor 309 and the water surface, and at the same time, achieving better monitoring accuracy and consistency.

According to an embodiment of the present invention, the water storage device 100 may further include an electric switch device 901 and a control device 900. The electric switch device 901 is configured to start and stop water supply of the water intake pipe 304. The control device 900 is connected to the ultrasonic sensor 309 and the electric switch device 901, and configured to control, based on a signal from the ultrasonic sensor 309, the action of the electric switch device 901 to inject or not to inject water into the pot body 200. By providing the electric switch device 901 and the control device 900, the water storage device 100 according to the embodiment of the present invention can realize intelligent control of water level monitoring and automatic water injection to meet the more convenient and intelligent domestic water demand of the user.

According to an embodiment of the present invention, the water storage device 100 may also be provided with a prompt device 902, which is configured to give a displacement reminder when the pot body 200 is not put in place. The prompt device 902 may be integrated inside the pot lid 300. The control device 900 is connected to the prompt device 902, and is configured to control the prompt device 902 to issue a displacement reminder when the magnetic sensitive switch 305 is not turned on. The reminder message may be, for example, chirping.

FIG. 12 is a control flow chart of placing the pot body 200 of the water storage device 100 shown in FIG. 2 into the inner container 402. After the pot body 200 is placed in the refrigerator 400, a method for controlling the water storage device 100 according to an embodiment of the present invention includes:

- S102: determining whether a magnetic sensitive switch 305 is turned on or not, executing S104 if yes and executing S110 if no;
- S104: determining whether an ultrasonic sensor 309 detects that the water level is reached, executing S106 if yes, and executing S108 if no;
- S106: controlling an electric switch device 901 to be turned off to stop water injection into the pot body 200;
- S108: controlling the electric switch device 901 to be turned on for injecting water into the pot body 200;
- S110: controlling a prompt device 902 to issue a displacement reminder.

After the pot body 200 is put in the refrigerator 400, whether the pot body 200 is put in place is determined first. Since the magnetic sensitive switch 305 may not be turned on until the pot body 200 is put in place, whether the pot body 200 is put in place can be determined by determining whether the magnetic sensitive switch 305 is turned on. Therefore, when the magnetic sensitive switch 305 is not turned on, it indicates that the pot body 200 is not accurately placed under the pot lid 300, and at this time, the prompt device 902 is controlled to issue a displacement reminder. When the magnetic sensitive switch 305 is turned on, it indicates that the pot body 200 is placed in place, and at this time, whether water needs to be injected into the pot body 200 is determined. When the ultrasonic sensor 309 detects that the water level is reached, the electric switch device 901 is controlled to be turned off for no water injection into the pot body 200. When the ultrasonic sensor 309 detects that the water level is not reached, the electric switch device 901 is controlled to be turned on, and water is injected into the pot body 200 till the ultrasonic sensor 309 detects that the water level is reached.

According to an embodiment of the present invention, the water storage device 100 further includes a signal processing circuit board 307, which is arranged in the pot lid 300, fixed to the top wall of the body portion 301, connected to the ultrasonic sensor 309 and the control device 900, and configured to receive a signal of the ultrasonic sensor 309 and transmit the received signal to the control device 900. In the body portion 301, a baffle plate 314 is arranged between the signal processing circuit board 307 and the water intake pipe 304. The baffle plate 314 is formed by extending downward from the top wall of the body portion 301, and is provided with a first section 3141 in the middle, and a second section 3142 and a third section 3143 on two sides of the first section 3141 respectively. The lower end of the first section 3141 is not lower than the signal processing circuit board 307, and the lower ends of the second section 3142 and the third section 3143 are lower than the first section 3141. The second section 3142 and the third section 3143 are provided to wrap two corners of the signal processing circuit board 307 close to the water intake pipe 304. By providing the U-shaped baffle plate 314, the water intake pipe 304 can be prevented from scratching the signal processing circuit board 307 during expansion and contraction. The lower end of the first section 3141 in the middle of the baffle plate 314 is not lower than the signal processing circuit board 307, which facilitates installation and fixation of the signal processing circuit board 307.

As shown in FIG. 6 and FIG. 9, a plug-in rod 312 and a fixing rod 313 are formed on a downward extension line on the top wall of the body portion 301, and the plug-in rod 312 and the fixing rod 313 are arranged diagonally. Fixing holes 371 are formed in the signal processing circuit board 307 corresponding to the plug-in rod 312 and the fixing rod 313 respectively. The signal processing circuit board 307 and the body portion 301 are fixed by threading a fixing member 372 through the fixing hole 371 and inserting the plug-in rod 312 into the fixing hole 371.

As shown in FIG. 11, the signal processing circuit board 307 may be powered up by the control device 900 (which may be a main control board of the refrigerator 400), and there is a signal transmission line therebetween. The ultrasonic sensor 309 is powered up by the signal processing circuit board 307, there is a signal transmission line therebetween, and there is also a magnetic sensitive switch 305 therebetween to control the ultrasonic sensor 309 to be powered up or not. The on/off state of the electric switch device 901 (for example, a solenoid valve) is controlled by the control device 900 according to a signal received from the signal processing circuit board 307. The prompt device 902 is controlled by the control device 900 according to a signal received from the signal processing circuit board 307.

In the descriptions of the embodiments, it should be understood that directional or positional relationships indicated by the terms such as "upper", "lower", "front", "rear", "left", "right", "vertical", "horizontal", "top" and "bottom" are directional or positional relationships as shown in the drawings, only for the purposes of the ease in describing the present disclosure and simplification of its descriptions, but not indicating or implying that the specified device or element has to be located in a specific direction, and structured and operated in a specific direction, and therefore, should not be understood as limitations to the present invention.

The terms "first" and "second" are only intended for description and shall not be construed to indicate or imply relative importance, or imply the number of the indicated technical features. Therefore, the features defined by "first" and "second" can indicate or imply that one or more features are included. In the descriptions of the present invention, unless otherwise specifically defined, "a plurality of" means two or more.

Therefore, those skilled in the art should realize that although multiple exemplary embodiments of the present invention have been illustrated and described in detail, many other variations or modifications that accord with the principle of the present invention may be still determined or derived directly from the content disclosed by the present invention without departing from the spirit and scope of the present invention. Thus, the scope of the present invention should be understood and deemed to include these and other variations or modifications.

What is claimed is:

1. A refrigerator, comprising:

a box body, an inner container of which defining a storage compartment therein, the inner container protrudes outward to form a socket;

a water storage device arranged in the storage compartment and comprising a pot body and a pot lid; the pot body being configured to storage water; the pot lid being arranged at the top of the pot body and configured to open and close the pot body; the pot lid is detachably connected with the inner container; and a fixing box fitted in the socket and fixed to the socket; wherein the pot lid is provided with a body portion and a fixing portion located on a side of the body portion close to the inner container, and the fixing portion is detachably connected with the fixing box.

2. The refrigerator according to claim 1, wherein a slot is formed in a top wall and/or a bottom wall of the fixing portion, and a jack is formed at a front wall and/or a rear wall of the fixing portion; and a flange is formed in the front part of a top wall and/or a bottom wall of the fixing box corresponding to the slot, and the flange is fitted in the slot through the jack to realize plug-in fixation of the fixing portion to the fixing box.

3. The refrigerator according to claim 2, wherein the jack is formed at a rear wall of the fixing portion;

the slot is configured such that a left-and-right width of a side wall of the slot on a side close to the inner container gradually decreases from front to back; and the flange is configured such that a left-and-right width of the flange gradually increases from front to back.

4. The refrigerator according to claim 2, wherein a clamping groove is also formed in the slot; and a protrusion is formed on the flange corresponding to the clamping groove, and the protrusion fits in the clamping groove.

5. The refrigerator according to claim 1, further comprising:

a shielding cover configured to fit the fixing box for shielding the fixing box after the pot lid is removed from the inner container.

6. The refrigerator according to claim 1, wherein the water storage device further comprises a water intake pipe arranged in the pot lid and having an outlet end extending into the pot body, and an inlet end connected to an external water pipe to introduce water into the pot body;

a communicating opening is formed in the fixing portion; and a through hole is formed in a side wall of the socket, a pipe inserting opening is formed in a side wall of the fixing box corresponding to the through hole, and the external water pipe passes through the through hole and the pipe inserting opening to be connected to the water intake pipe.

7. The refrigerator according to claim 6, further comprising:

an anti-overflow plug with a pipe fixing hole formed therein, wherein the anti-overflow plug passes through the through hole on an outer side of the inner container, and the external water pipe passes through the pipe fixing hole to be fixed to the anti-overflow plug.

8. The refrigerator according to claim 7, wherein at least one first fixing hole is formed in the side wall of the socket, and an adsorption head is formed on an outer side of the side wall corresponding to the first fixing hole;

a second fixing hole is formed in a side wall of the fixing box corresponding to the first fixing hole; and the refrigerator further comprises a screw davit which fits and is fixed to the adsorption head, and a fixing member passes through the second fixing hole, the first fixing hole and the adsorption head to fix the fixing box to the inner container.

9. The refrigerator according to claim 6, wherein the inlet end of the water intake pipe is detachably connected with the external water pipe by means of a quick connector; and the quick connector comprises a first connecting pipe joint and a second connecting pipe joint, the inlet end of the water intake pipe is inserted into the first connecting pipe joint, the second connecting pipe joint is provided with a first pipe section and a second pipe section connected to each other, a tail end of the first pipe section is inserted into the second connecting pipe joint, an outlet end of the external water pipe is inserted into the second pipe section, and an inner diameter of the second pipe section is greater than that of the first pipe section.

10. The refrigerator according to claim 6, wherein the water intake pipe is a flexible pipe, of which at least some sections are of spirally-bent structures.

11. The refrigerator according to claim 6, wherein a plug-in post is formed on a bottom cover of the pot lid, and the outlet end of the water intake pipe is inserted into the plug-in post; and a support plate is further formed on the bottom cover close to the plug-in post, a first notch and a second notch are sequentially formed in the support plate up and down, a size of the second notch is larger than that of the first notch, and some pipe sections of the water intake pipe are fitted into in the second notch through the first notch.

* * * * *